US010386044B2

(12) United States Patent
Zhou et al.

(10) Patent No.: US 10,386,044 B2
(45) Date of Patent: Aug. 20, 2019

(54) LED LIGHT DEVICE WITH CHANGABLE BEAM ANGLE

(71) Applicant: XIAMEN ECO LIGHTING CO., LTD., Xiamen, Fujian Province (CN)

(72) Inventors: Yaling Zhou, Xiamen (CN); Xiaoming Yang, Xiamen (CN); Bin Yi, Xiamen (CN)

(73) Assignee: XIAMEN ECO LIGHTING CO., LTD. (CN)

( * ) Notice: Subject to any disclaimer, the term of this patent is extended or adjusted under 35 U.S.C. 154(b) by 0 days.

(21) Appl. No.: 15/829,823

(22) Filed: Dec. 1, 2017

(65) Prior Publication Data

US 2018/0245778 A1 Aug. 30, 2018

Related U.S. Application Data

(60) Provisional application No. 62/521,473, filed on Jun. 18, 2017.

(30) Foreign Application Priority Data

Feb. 27, 2017 (CN) ..... 2017 2 0181087 U

(51) Int. Cl.

| | |
|---|---|
| ***F21S 8/00*** | (2006.01) |
| ***F21V 17/00*** | (2006.01) |
| ***F21V 5/00*** | (2018.01) |
| ***F21V 29/83*** | (2015.01) |
| ***F21K 9/69*** | (2016.01) |
| ***F21V 11/16*** | (2006.01) |

(Continued)

(52) U.S. Cl.

CPC ..... *F21V 17/002* (2013.01); *F21K 9/69* (2016.08); *F21V 5/007* (2013.01); *F21V 5/008* (2013.01); *F21V 11/16* (2013.01); *F21V 29/83* (2015.01); *F21Y 2105/10* (2016.08); *F21Y 2115/10* (2016.08)

(58) Field of Classification Search

CPC ..... F21V 5/008; F21V 5/10; F21V 13/02
USPC ..... 362/268, 285, 291, 292
See application file for complete search history.

(56) References Cited

U.S. PATENT DOCUMENTS 5,138,540 A * 8/1992 Kobayashi ..... B60Q 1/122 362/268
2003/0048737 A1* 3/2003 Nakamura ..... G11B 7/127 369/112.19

(Continued)

*Primary Examiner* — Daniel St Cyr
(74) *Attorney, Agent, or Firm* — PROI Intellectual Property US

(57) ABSTRACT

The present invention relates to an optical device capable of effecting changeable beam angles. The optical device includes a light source plate, a convergence lens, and at least two diffusion lenses. When one of the at least two diffusion lenses is in use, the rest of the at least two diffusion lenses are in a stand-by state. The optical device is configured such that the light emitted by the light source plate is collimated by the convergence lens and allowed to go through the diffusion lens in use to be diffused. The optical device is configured to cause the collimated light incident on refraction surfaces of the different diffusion lenses with different incident angles to exit from the different diffusion lenses with different emergence angles. The optical device is capable of employing different diffusion lenses for changing the beam angle of the optical device.

14 Claims, 4 Drawing Sheets

(51) Int. Cl.
*F21Y 105/10* (2016.01)
*F21Y 115/10* (2016.01)

(56) References Cited

U.S. PATENT DOCUMENTS

2008/0054170 A1* 3/2008 Okano ..... G01D 5/34715
250/231.14
2009/0086330 A1* 4/2009 Matsuzaki ..... G11B 7/1353
359/648

* cited by examiner

LED LIGHT DEVICE WITH CHANGABLE BEAM ANGLE

CROSS REFERENCE TO RELATED APPLICATIONS

The present application claims priority to Chinese Patent Application CN 201720181087.6 filed on Feb. 27, 2017 and to U.S. provisional application U.S. 62/521,473 filed on Jun. 18, 2017.

TECHNICAL FIELD

The present disclosure relates to light devices, and particularly, to an LED light device.

BACKGROUND

In an application scene of directional lights, different targets need to be illuminated by light devices with different beam angles. Accordingly, the factories need to produce light devices of various specifications with different beam angles, and users need to buy light devices of different specifications. Thus, a production cost and a purchase cost are both relatively high.

SUMMARY

A main problem of the present invention is to provide a combined optical device, which is capable of effecting changeable beam angles.

To solve the above technical problem, the present invention, the present invention provides an optical device capable of effecting changeable beam angles. The optical device includes a light source plate, a convergence lens, and at least two diffusion lenses. One of the at least two diffusion lenses is in use, while the rest of the at least two diffusion lenses are in a stand-by state.

The optical device is configured such that the light emitted by the light source plate is collimated by the convergence lens and allowed to go through the diffusion lens in use to be diffused; the optical device is configured to cause the collimated light incident on refraction surfaces of the different diffusion lenses with different incident angles to exit from the different diffusion lenses with different emergence angles. The optical device is capable of employing different diffusion lenses for changing the beam angle of the optical device.

In a preferred embodiment, each one of the at least two diffusion lenses includes a first planar surface facing the convergence lens, a second surface facing away from the convergence lens, and a plurality of protrusions continuously formed on the second surface; the protrusions form the refraction surfaces.

In a preferred embodiment, for different diffusion lenses, heights of the protrusions are different.

In a preferred embodiment, the emergence angles are in a range from 10° to 90°.

In a preferred embodiment, the optical device further includes a glare suppressing ring, wherein the glare suppressing ring has an opening extending from a front end to a back end along a light exiting direction, and a diameter of the opening increases gradually from the back end to the front end; one of the at least two diffusion lenses is arranged at the opening at the back end.

In a preferred embodiment, the glare suppressing ring includes a pressing ring extending inwardly along a radial direction at the opening at the back end; each one of the at least two diffusion lenses has an planar circular ring at the periphery on the second surface; the pressing ring abuts against the planar circular ring, thus fixing the diffusion lens in the opening at the back end of the glare suppressing ring.

In a preferred embodiment, the optical device is an LED lamp.

In a preferred embodiment, the optical device further includes an outer shell, wherein the outer shell includes two open ends at two opposite ends along an axial direction thereof, the outer shell defines a receiving chamber in communication with the open ends; the light source plate is arranged outside of the open end at a bottom of the outer shell, the convergence lens and the first diffusion lens are sequentially arranged above the light source plate.

In a preferred embodiment, the optical device further includes a heat sink, wherein the heat sink is arranged at the open end at the bottom of the outer shell along the axial direction of the LED lamp, the heat sink defines a cavity groove in an end surface adjacent to the outer shell, and the cavity groove is configured for receiving the light source plate.

In comparison with related art, the present invention exhibits the following advantages:

The present invention provides a combined optical device capable of effecting changeable beam angles. The aim of changing beam angles is achieved by replacing different diffusion lenses. Since incident angles of light on a refraction surface of each diffusion lens are different, emergence angles of outgoing light are different; thus, changing beam angles quickly can be achieved. To meet demand of different application scenes, users only need to buy a plurality of diffusion lenses. Factories only need to produce diffusion lenses of various specifications, do not need to produce lamps of various specifications, thus reducing cost.

The present invention provides a combined optical device. Since some light enters the diffusion lens directly without passing the convergence lens, the light passes through the diffusion lens to form a stray light. When the stray light irradiates human eyes directly, the stray light may cause users discomfort. By setting the glare suppressing ring, the stray light is blocked, thus improving user experience.

DETAILED DESCRIPTION

The present disclosure will be described in detail as follows in view of several embodiments and the accompanying drawings.

Figure 1:
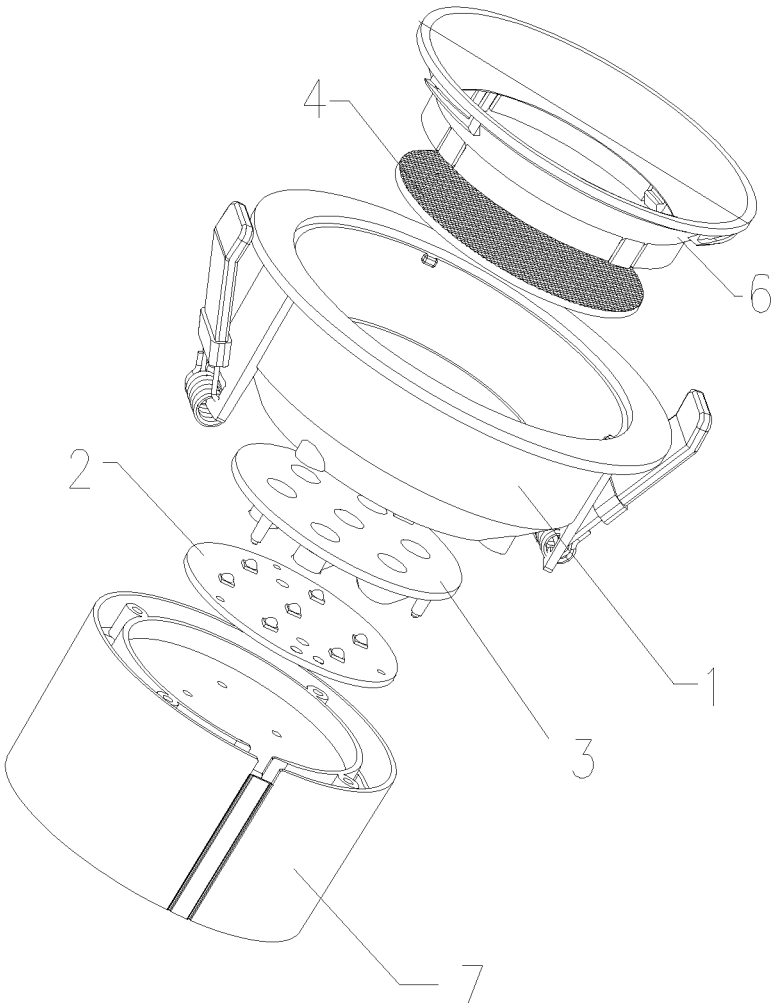
FIG. 1 is an exploded perspective view of an LED lamp according to a preferred embodiment of the present invention.
Figure 2:
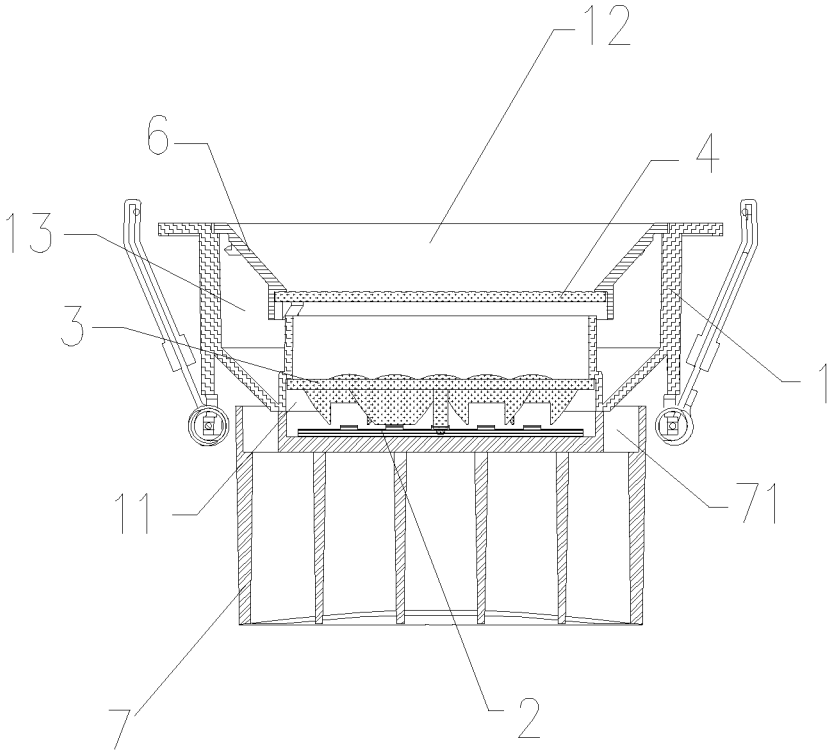
FIG. 2 is a cross-sectional view of the LED lamp according to a preferred embodiment of the present invention.
Figure 3:
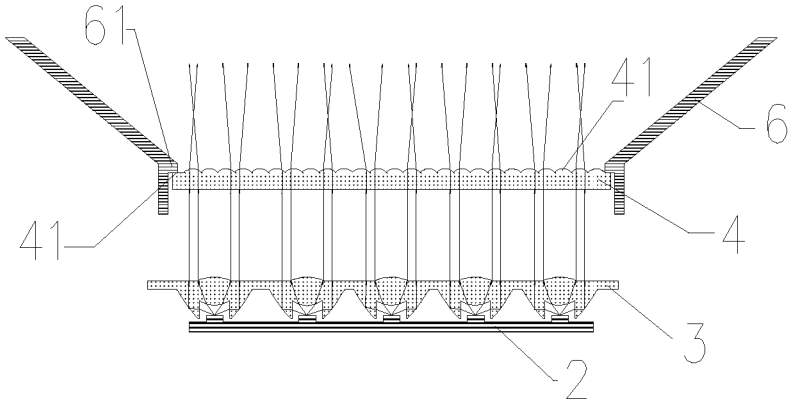
FIG. 3 is a light path diagram of light exit from the first diffusion lens according to a preferred embodiment of the present invention.
Figure 4:
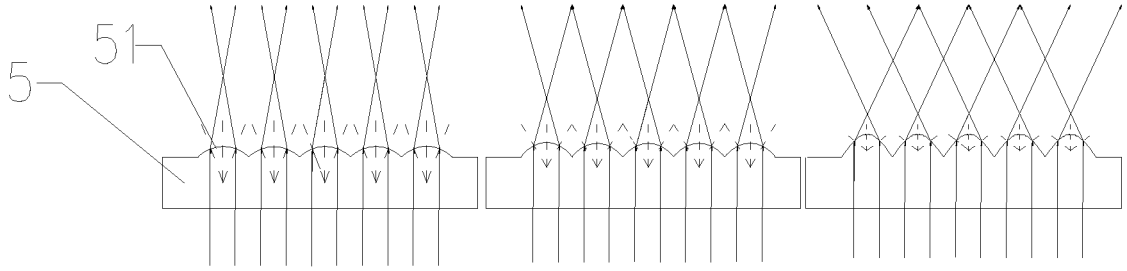
FIG. 4 is a light path diagram of light exit from the backup diffusion lens according to a preferred embodiment of the present invention.

Please refer to FIG. 1 to FIG. 3, which illustrate an embodiment of a LED light device that can change beam angle. Such light device includes an outer shell 1, a light source plate 2, a convergence lens 3 and a first diffusion lens 4.

Two ends of the outer shell 1 along the axis direction are the opening 11 and the opening 12. The outer shell 1 has an accommodating cavity 13 connecting the opening 11 and the opening 12. The light source plate 2 is placed at the opening 11 at the bottom. The convergence lens 3 and the first diffusion lens 4 are placed above the light source plate 2 in sequence.

The convergence lens 3 collimates the light from the light source plate 2 to be emitted to the first diffusion lens 4 to be diffused to form an outgoing light angle.

A backup diffusion lens 5 is also provided. After the backup diffusion lens 5 has replaced the first diffusion lens 4, an incident angle of the collimated light formed on the refraction surface of the backup diffusion lens 5 is different from that formed on the refraction surface of the first diffusion lens 4. Accordingly, the emergence angles of outgoing light are different between the first diffusion lens 4 and the backup diffusion lens 5. Therefore, the beam angle is changed by replacing the first diffusion lens 4 with the backup diffusion lens 5. Therefore, a user only needs to obtain a plurality of diffusion lenses to meet different demand of different application scenes. Meanwhile, manufacturers only need to produce diffusion lenses of various specifications, and do not need to produce light devices of various specifications, thus reducing production cost.

To achieve light diffusion, the surfaces of the first diffusion lens 5 and the backup diffusion lens 5 facing the convergence lens 3 are flat surfaces. The other surfaces of the first diffusion lens 4 and the backup diffusion lens 5 have a plurality of convex portions 41, 51 continuously formed. The convex portions 41, 51 form refraction surfaces. When collimated light enters the flat surface, the incident angle is not changed, but the emergence angles will be changed when the collimated light is refracted by the refraction surfaces.

To achieve different emergence angles for different diffusion lens, the first diffusion lens 4 and the backup diffusion lens 5 have different protruding heights on their convex portions 41, 51. By adjusting the protruding heights of the convex portions 41, 51, the beam angle may be ranged between 10 degrees to 90 degrees.

Some portion of light may escape from the convergence lens 2 and form stray light after passing the diffusion lens. When irradiating human eyes directly, the stray light may cause users discomfort. To eliminate such undesired strayed light, a glare suppressing ring 6 may be provided, which has an opening at the front end and the back end along light emergence direction. The diameter of the opening increases from the back end to the front end. The glare suppressing ring 6 is placed in the accommodating cavity 13. An outer peripheral of the suppressing ring 6 at the front end is fixed to an inner edge of the opening 12 at the top of the outer shell 1. The first diffusion lens 4 is installed at the opening of the back end of the glare suppressing ring 6.

A pressing ring 61 may be provided extending inward radially at the opening of the back end of the glare suppressing ring 6. Planar circular rings 42, 52 may be placed at outer peripheral of the side with convex portions 41, 51 at the first diffusion lens 4 and the backup diffusion lens 5. The pressing ring 61 abuts to the planar circular ring 42, 52 to fix the first diffusion lens 4 or the backup diffusion lens 5 at the opening of the back end of the glare suppressing ring 6.

A heat sink 7 may be provided and placed at the opening 11 at the bottom of the outer shell 1 along an axial direction. The heat sink 7 has a cavity groove 71 in an end surface adjacent to the outer shell 1. The cavity groove 71 is configured for placing the light source plate 2.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is to be claimed is:

1. An optical device capable of effecting changeable beam angles, wherein the optical device comprises: a light source plate; a convergence lens; and at least two diffusion lenses; wherein when one of the at least two diffusion lenses is in use, the rest of the at least two diffusion lenses are in a stand-by state; wherein the optical device is configured such that the light emitted by the light source plate is collimated by the convergence lens and allowed to go through the diffusion lens in use to be diffused; wherein the optical device is configured to cause the collimated light incident on refraction surfaces of the different diffusion lenses with different incident angles to exit from the different diffusion lenses with different emergence angles; wherein the optical device is capable of employing different diffusion lenses for changing the beam angle of the optical device, further comprising a glare suppressing ring, wherein the glare suppressing ring has an opening extending from a front end to a back end along a light exiting direction, and a diameter of the opening increases gradually from the back end to the front end; one of the at least two diffusion lenses is arranged at the opening at the back end.

2. The optical device according to claim 1, wherein each one of the at least two diffusion lenses comprises a first planar surface facing the convergence lens, a second surface facing away from the convergence lens, and a plurality of protrusions continuously formed on the second surface; the protrusions form the refraction surfaces.

3. The optical device according to claim 2, wherein for different diffusion lenses, heights of the protrusions are different.

4. The optical device according to claim 3, further comprising a glare suppressing ring, wherein the glare suppressing ring has an opening extending from a front end to a back end along a light exiting direction, and a diameter of the opening increases gradually from the back end to the front end; one of the at least two diffusion lenses is arranged at the opening at the back end.

5. The optical device according to claim 4, wherein the glare suppressing ring comprises a pressing ring extending inwardly along a radial direction at the opening at the back end; each one of the at least two diffusion lenses has an planar circular ring at the periphery on the second surface; the pressing ring abuts against the planar circular ring, thus fixing the diffusion lens in the opening at the back end of the glare suppressing ring.

6. The optical device according to claim 2, wherein the emergence angles are in a range from 10° to 90°.

7. The optical device according to claim 6, further comprising a glare suppressing ring, wherein the glare suppressing ring has an opening extending from a front end to a back end along a light exiting direction, and a diameter of the opening increases gradually from the back end to the front end; one of the at least two diffusion lenses is arranged at the opening at the back end.

8. The optical device according to claim 7, wherein the glare suppressing ring comprises a pressing ring extending inwardly along a radial direction at the opening at the back end; each one of the at least two diffusion lenses has an planar circular ring at the periphery on the second surface; the pressing ring abuts against the planar circular ring, thus fixing the diffusion lens in the opening at the back end of the glare suppressing ring.

9. The optical device according to claim 2, further comprising a glare suppressing ring, wherein the glare suppressing ring has an opening extending from a front end to a back end along a light exiting direction, and a diameter of the opening increases gradually from the back end to the front end; one of the at least two diffusion lenses is arranged at the opening at the back end.

10. The optical device according to claim 9, wherein the glare suppressing ring comprises a pressing ring extending inwardly along a radial direction at the opening at the back end; each one of the at least two diffusion lenses has an planar circular ring at the periphery on the second surface; the pressing ring abuts against the planar circular ring, thus fixing the diffusion lens in the opening at the back end of the glare suppressing ring.

11. The optical device according to claim 1, wherein the glare suppressing ring comprises a pressing ring extending inwardly along a radial direction at the opening at the back end; each one of the at least two diffusion lenses has an planar circular ring at the periphery on the second surface; the pressing ring abuts against the planar circular ring, thus fixing the diffusion lens in the opening at the back end of the glare suppressing ring.

12. The optical device according to claim 1, being an LED lamp.

13. The optical device according to claim 12, further comprising an outer shell, wherein the outer shell comprises two open ends at two opposite ends along an axial direction thereof, the outer shell defines a receiving chamber in communication with the open ends; the light source plate is arranged outside of the open end at a bottom of the outer shell, the convergence lens and the first diffusion lens are sequentially arranged above the light source plate.

14. The optical device according to claim 13, further comprising a heat sink, wherein the heat sink is arranged at the open end at the bottom of the outer shell along the axial direction of the LED lamp, the heat sink defines a cavity groove in an end surface adjacent to the outer shell, and the cavity groove is configured for receiving the light source plate.

* * * * *